US005666777A

United States Patent [19]

Murphy

[11] Patent Number: 5,666,777

[45] Date of Patent: Sep. 16, 1997

[54] BUILDING BLOCK HAVING INTERLOCKING FORMATIONS

[76] Inventor: Ronald Patrick Murphy, 2 Shaftesbury Place, Binfield, Bracknell, Berkshire, United Kingdom, RG12 5BU

[21] Appl. No.: 381,830

[22] PCT Filed: May 26, 1993

[86] PCT No.: PCT/GB93/01081

§ 371 Date: Feb. 7, 1995

§ 102(e) Date: Feb. 7, 1995

[87] PCT Pub. No.: WO94/04767

PCT Pub. Date: Mar. 3, 1994

[30] Foreign Application Priority Data

Aug. 12, 1992 [GB] United Kingdom ..... 9217036

[51] Int. Cl.[6] ..... E04B 5/04

[52] U.S. Cl. ..... 52/604; 52/424; 405/286; 446/128

[58] Field of Search ..... 52/596, 604, 598, 52/603, 422, 424, 430, 428, 589.1, 590.2, 591.2, 591.3, 592.1, 592.2, 405.4; 405/16, 19, 286, 284; 446/125, 128

[56] References Cited

U.S. PATENT DOCUMENTS 4,614,071 9/1986 Sams et al. ..... 52/405.4 X

FOREIGN PATENT DOCUMENTS 379389 7/1990 European Pat. Off. ..... 446/125
117142 7/1918 United Kingdom .
222393 10/1924 United Kingdom .
673470 6/1952 United Kingdom .
1 173 520 12/1969 United Kingdom .
1 295 280 11/1972 United Kingdom .
2231502 11/1990 United Kingdom ..... 446/125

*Primary Examiner*—Creighton Smith
*Attorney, Agent, or Firm*—Westman, Champlin & Kelly, P.A.

[57] ABSTRACT

There is provided a building block (10) comprising a rectangular parallelepiped having three pairs of opposing surfaces (12 and 14, 16 and 18 and 20 and 22), each pair of opposing surfaces being provided with one or more identical pairs of interlocking formations (24 and 26), whereby two such building blocks (10) may be arranged with one of a pair of opposing surfaces of a first of the blocks in interlocking engagement with one of any of the three pairs of opposing surfaces of the other of the blocks. There is also provided a corner block (100) for use with a building block (10) of the type previously described, the corner block (100) subtending in included angle and being provided with one or more formations (118) on each of its surfaces (102–116) whereby the corner block (100) may be arranged with one of its surfaces (102–116) in interlocking engagement with one of at least one of each pair of opposing surfaces (12 and 14, 16 and 18 or 20 and 22) of said building block (10). There is also provided a construction comprising a first building block (10) in the form of a rectangular parallelepiped having three pairs of opposing surfaces (12 and 14, 16 and 18 and 20 and 22), each pair of opposing surfaces being provided with one or more identical pairs of interlocking formations (24 and 26), and either a second such building block (10) or a corner block (100), the corner block (100 subtending an included angle and being provided with one or more formations (118) on each of its surfaces (102–116), the blocks (10 and either 10 or 100) being arranged with one of a pair of opposing surfaces of said first building block (10) in interlocking engagement with either one of any of the three pairs of opposing surfaces of said second building block (10) or one of the surfaces (102–116) of said corner block (100).

22 Claims, 7 Drawing Sheets

BUILDING BLOCK HAVING INTERLOCKING FORMATIONS

The present invention relates to a building block having interlocking formations, to a corner block for use with such a building block and to a construction comprising two or more such blocks in interlocking engagement or one such building block in interlocking engagement with a corner block.

In the past it has been known to provide a building block comprising a rectangular parallelepiped having three pairs of opposing surfaces in which one of the pairs of opposing surfaces is provided with complimentary interengaging formations while the remaining pairs of opposing surfaces remain substantially planer. An example of one such arrangement is provided in GB-A-2,075,571 which describes a brick suitable for constructing a wall or the like having a major surface which includes, spaced from the edge of the brick, two upraised projections and an opposite major surface which includes, spaced from the edges of the brick, two corresponding recesses, the projections and recesses being arranged so that two identical bricks may be placed end to end with their projections uppermost and a third identical brick placed on top of the other two with one of its recesses accommodating one projection from one of said two bricks and one of its recesses accomodating one projection from the other of said two bricks thereby interlocking the bricks.

A further example of this kind of arrangement is provided in GB-A-2,185,276 in which there is described a generally rectangular interlocking building block having complimentary projections and recesses on opposite of its major surfaces, the projections being provided by ribs arranged to form at least one upstanding cruciform shape.

One of the problems with building blocks of this type however is that in order to erect a construction, such as a vertical wall, the blocks must be arranged in one of the limited number of orientations in which their major surfaces are substantially horizontal. This limits not only the design of any contructions incorporating the blocks but also slows down the actual laying process since each block must first be correctly orientated before then being placed in engagement with those already in position.

In a different field it has been known to provide a paving block having a pair of opposed, parallel, substantially planer surfaces but with side walls and end walls contoured to provide an interengagement with adjacent blocks when laid on a surface. An example of one such arrangement is provided in GB-B-2,120,699 which describes a paving block in which at least one of the parallel surfaces is patterned in relief in a geometrical manner related to the side and end contours of the block and in such a manner that the pattern on one block integrates with the pattern on blocks laid adjacent to the one block.

Another example of this kind of arrangement is provided in GB-A-2,134,561.

It is an aim of the present invention to provide a building block capable of interlocking engagement with another such building block in an increased number of desired orientations.

According to a first aspect of the present invention, there is provided a building block comprising a rectangular parallelpiped having three pairs of opposing surfaces, each pair of opposing surfaces being provided with one or more identical pairs of interlocking formations, whereby two such building blocks may be arranged with one of a pair of opposing surfaces of a first of the blocks in interlocking engagement with one of any of the three pairs of opposing surfaces of the other of the blocks.

Advantageously the formations provided on one of the surfaces of each pair of opposing surfaces may be spaced apart to the same extent as those provided on the corresponding surface of the other two pairs of opposing surfaces.

Advantageously each of the formations may be symetric about a rotation of 90°.

Advantageously each of the formations may comprise a square matrix of projecting and recessed elements. Preferably the projecting and recessed elements may each be in the form of a square based pyramid.

Advantageously the rectangular parallelepiped may be hollow. The cavity defined by the hollow parallelepiped may contain a heat insulating material or alternatively may be evacuated.

Advantageously the building block may contain one or more reinforcing elements.

According to a second aspect of the present invention there is provided a corner block for use with a building block of the type previously described, the corner block subtending an included angle and being provided with one or more formations on each of its surfaces whereby the corner block may be arranged with one of its surfaces in interlocking engagement with one of at least one of each pair of opposing surfaces of said building block.

Advantageously each of the formations provided on the surfaces of the corner block may comprise a square matrix of projecting and/or recessed elements. Preferably the projecting and recessed elements may each be in the form of a square based pyramid.

Advantageously each of the formations provided on the surfaces of the corner block may be such as to allow the corner block to be arranged with one of its surfaces in interlocking engagement with one of any of the three pairs of opposing surfaces of said building block. Preferably each of the formations provided on the surfaces of the corner block may be identical. Preferably each of the formations provided on the surfaces of the corner block may comprise a square matrix of solely recessed elements. Preferably the recessed elements may each be in the form of a square based pyramid.

Advantageously the corner block may have an included angle that is an integer multiple of 15° within the range from 90° to 165°.

Advantageously the corner block may be hollow. The cavity defined by the hollow corner block may contain a heat insulating material or alternatively may be evacuated.

Advantageously the corner block may contain one or more reinforcing elements.

According to a third aspect of the present invention there is provided a construction comprising a first building block in the form of a rectangular parallelepiped having three pairs of opposing surfaces, each pair of opposing surfaces being provided with one or more identical pairs of interlocking formations, and either a second such building block or a corner block, the corner block subtending an included angle and being provided with one or more formations on each of its surfaces, the blocks being arranged with one of a pair of opposing surfaces of said first building block in interlocking engagement with either one of any of the three pairs of opposing surfaces of said second building block or one of the surfaces of said corner block.

Advantageously the blocks may be cemented together by means of an airtight sealant.

A number of embodiments of the various aspects of the present invention will now be described by way of example with reference the accompanying drawings in which.

Figure 1:
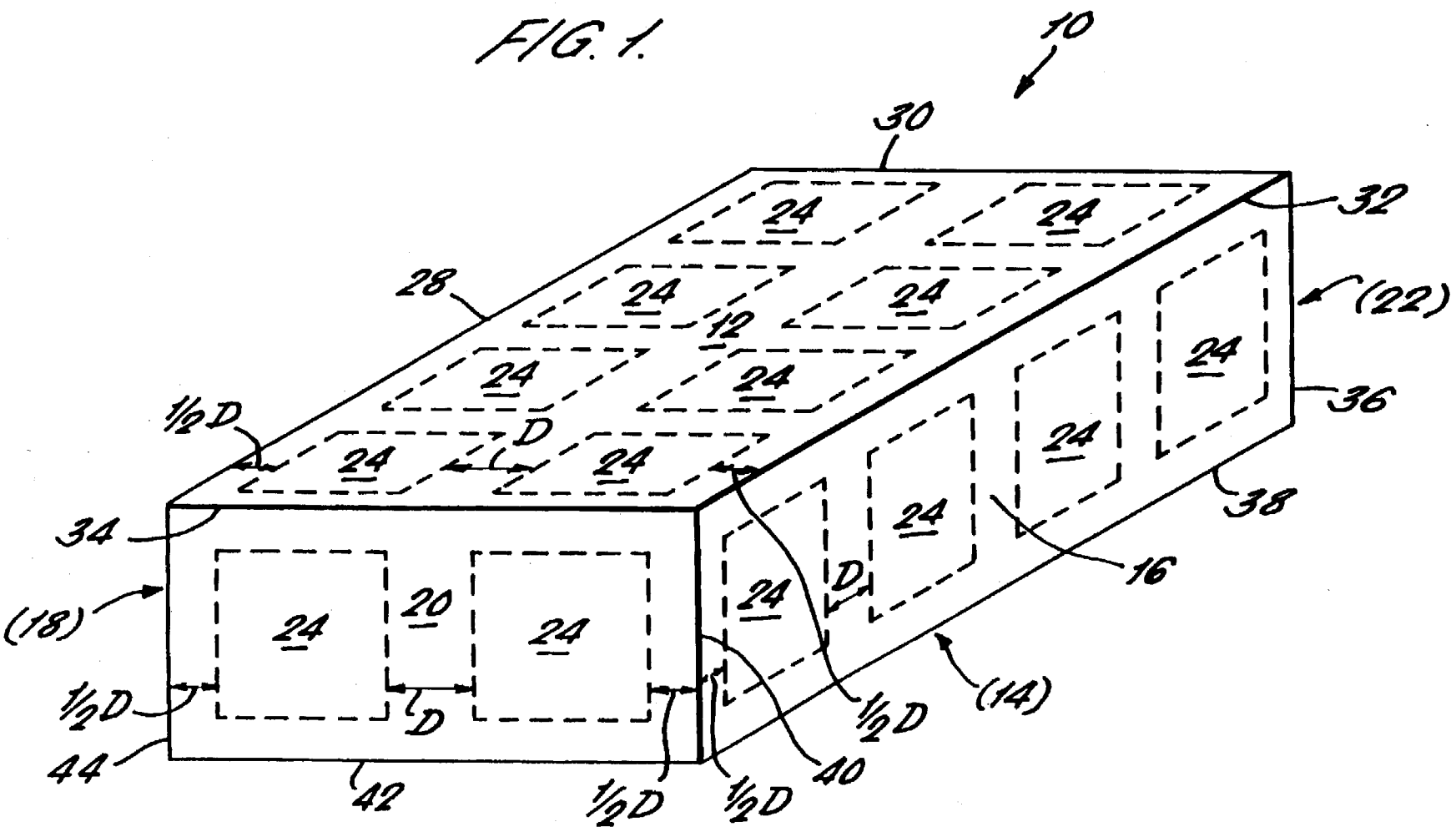
FIG. 1 is a schematic perspective view of a building block in accordance with the first aspect of the present invention.

Referring to FIG. 1 a building block 10 in accordance with a first aspect of the present invention can be seen to comprise a rectangular parallelepiped having three pairs of opposing surfaces 12 and 14, 16 and 18 and 20 and 22. Each pair of opposing surfaces is provided on one of its surfaces 12,16 and 20 with one or more formations 24 while the other surface of each pair of opposing surfaces 14,18 and 22 is provided with a corresponding number of different but complimentary formations 26. The formations 24 and 26, irrespective of type, are equally spaced apart on their respective surfaces. Thus, referring to FIG. 1 for example, the upper surface 12 is provided with eight identical formations 24 disposed in two rows of four with each formation spaced a distance D from the nearest neighbouring formation 24 and a distance ½D from the edges 28,30,32 and 34. Likewise, the right hand side surface 16 is provided with a single row of four formations 24 identical not only to each other but also to those provided on the upper surface 12, each again spaced a distance D from the nearest neighbouring formation 24 and a distance ½D from the edges 32,36,38 and 40. Finally as far as the first type of formations 24 are concerned, the near end surface 20 is provided with a single row of two formations 24 which are identical not only to each other but also to those provided on both the upper surface 12 and on the right hand side surface 16. These two formations 24 are also spaced a distance D apart and a distance ½D from the edges 34,40,42 and 44.

As for the surfaces provided with the complimentary formations 26, the lower surface 14 (not shown) is provided, like its opposing counterpart 12, with eight identical formations 26 disposed in two rows of four. As before, each complimentary formation 26 is spaced a distance D from the nearest neighbouring formation 26 and a distance ½D from the edges 38,42,46 and 48 (only two of which are shown). Likewise, the left hand side surface 18 (not shown), like its opposing counterpart 16, is provided with a single row of four formations 26 identical not only to each other but also to those provided on the lower surface 14, each again being spaced a distance D from the nearest neighbouring formations 26 and a distance ½D from the edges 28,44,46 and 50 (only two of which are shown). Finally, the far end surface 22 (not shown), like its opposing counterpart 20, is provided with a single row of two formations 26 which are again identical not only to each other but also to those provided on both the lower surface 14 and left hand side surface 18. These two complimentary formations 26 are also spaced a distance D apart and a distance ½D from the edges 36,48 and 50 (only two of which are shown).

Figure 2:
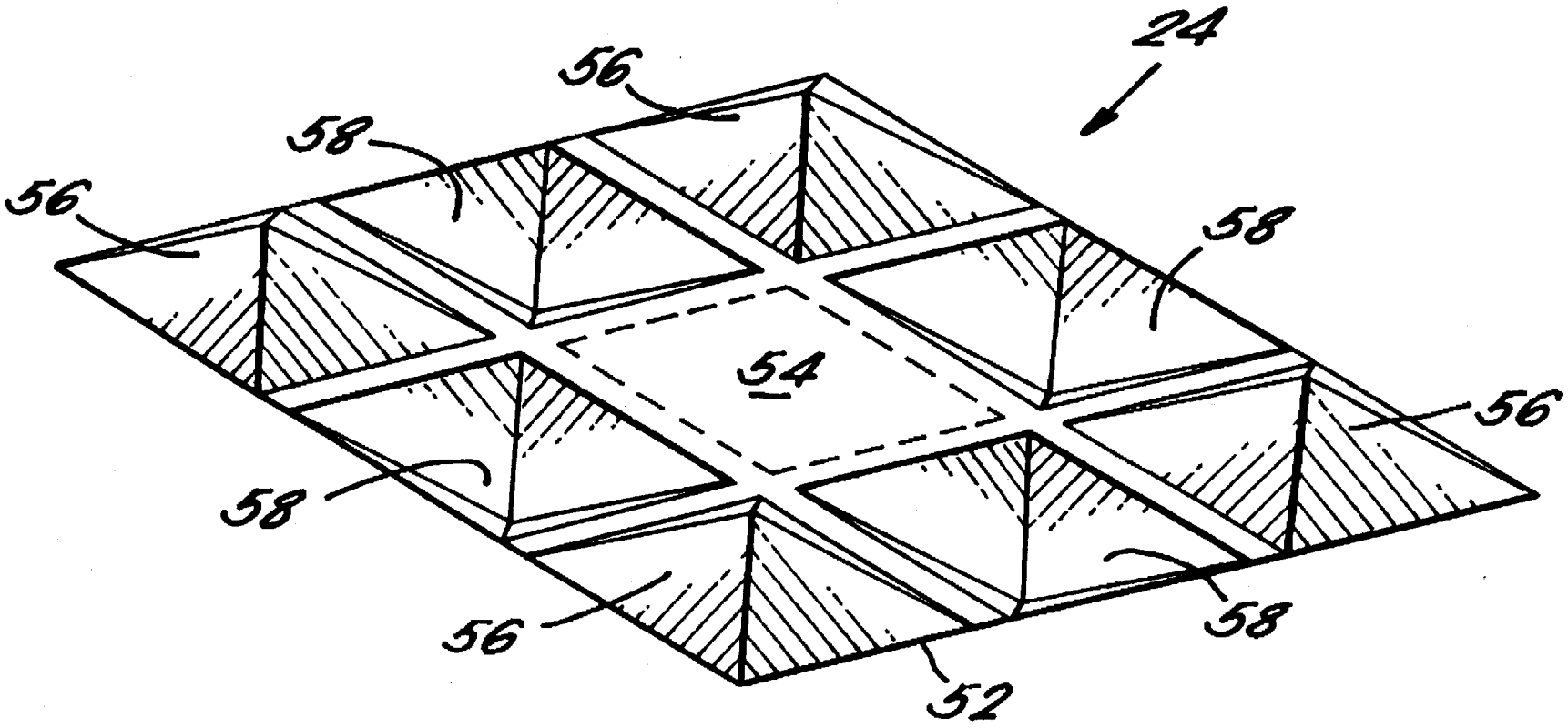
FIG. 2 is perspective view of a first of the interlocking formations provided on the building block of FIG. 1.

The first type of formation 24 is shown in more detail in FIG. 2 to comprise a three by three matrix of elements arranged in the form of a square 52 in which the central element 54 is substantially co-planer with the relevant surface of the building block 10. Of the remaining eight elements, four comprise square based pyramids 56 that project from the surface while the other four comprise similarly shaped recesses 58. As shown in FIG. 2, the projections and recesses 56 and 58 are disposed alternately around the perimeter of the square 52 with the projections 56 located in the corners.

Figure 3:
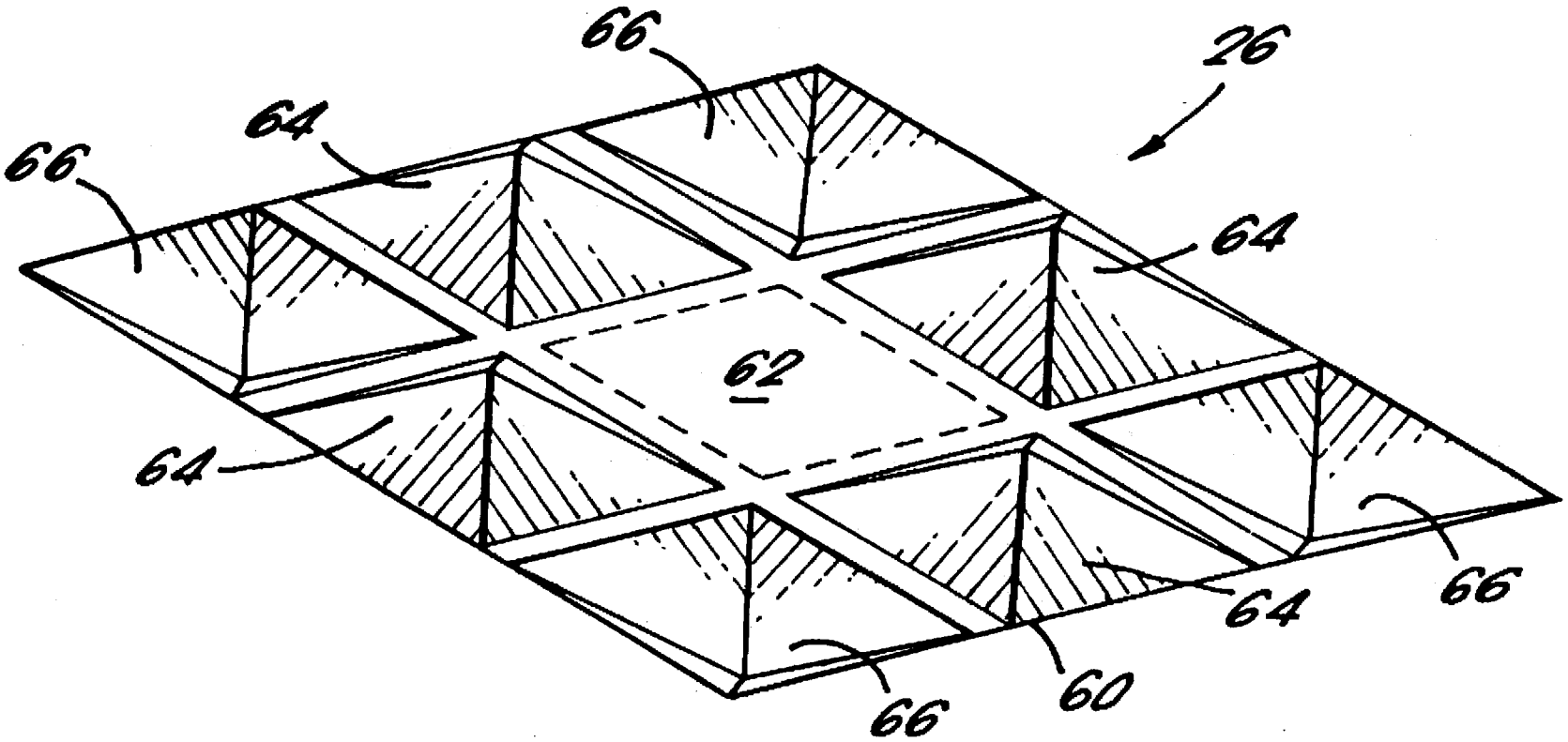
FIG. 3 is a perspective view of a second and complimentary interlocking formation provided on the building block of FIG. 1.

One of the complimentary formations 26 is shown in more detail in FIG. 3 and again comprises a three by three matrix of elements arranged in the form of a square 60 with the central element 62 substantially co-planer with the relevant surface of the building block 10. As before, of the remaining eight elements, four comprise square based pyramids 64 that project from the surface of the block while the other four comprise similarly shaped recesses 66. As shown in FIG. 3, the projections and recesses 64 and 66 are disposed alternately around the perimeter of the square 60 with this time the recesses 66 located in the corners.

In use, in order to arrange two blocks of the type described in mutual interlocking engagement all that is required is to place any one of the surfaces 12,16, or 20 of one of the blocks in abutting relationship with any one of the surfaces 14,18 or 22 of the other of the blocks. In this way one or more of the first type of formations 24 are brought into engagement with a corresponding number of the complimentary formations 26 with the result that the projections 56 of the first type of formations 24 are received within the recesses 66 of the complimentary formations 26 and the projections 64 of the complimentary formations 26 are received within the recesses 58 of the first type of formations 24.

Since each of the surfaces 12,16, and 20 are mutually orthogonal, as are the opposing surfaces 14,18 and 22, and because both the first type of formation 24 and the complimentary formation 26 are symetric about a rotation of 90° the two blocks may be arranged in mutual interlocking engagement in any desired orientation.

Figure 4:
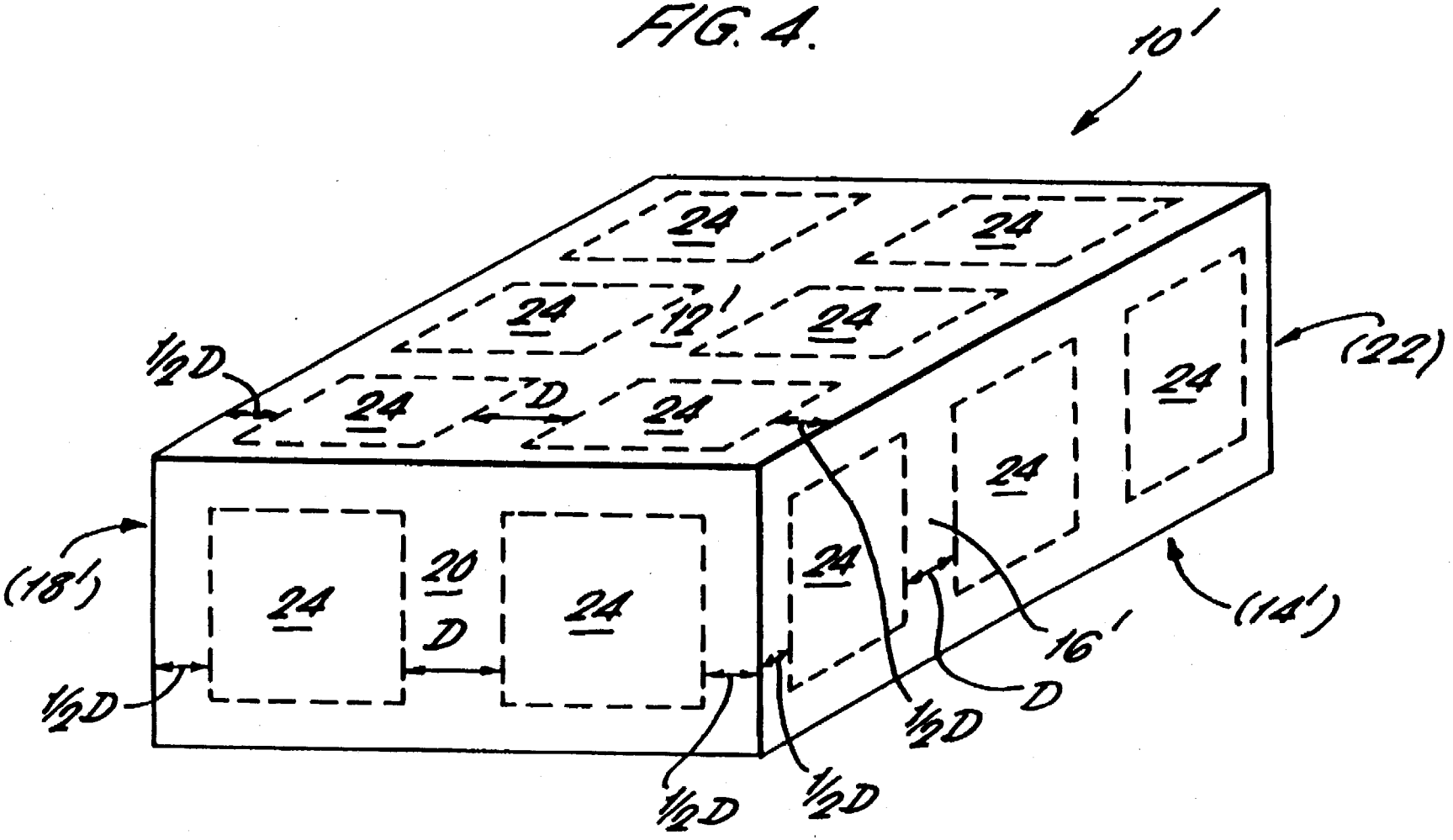
FIG. 4 is a schematic perspective view of a building block in accordance with a second embodiment of the first aspect of the present invention.
Figure 5:
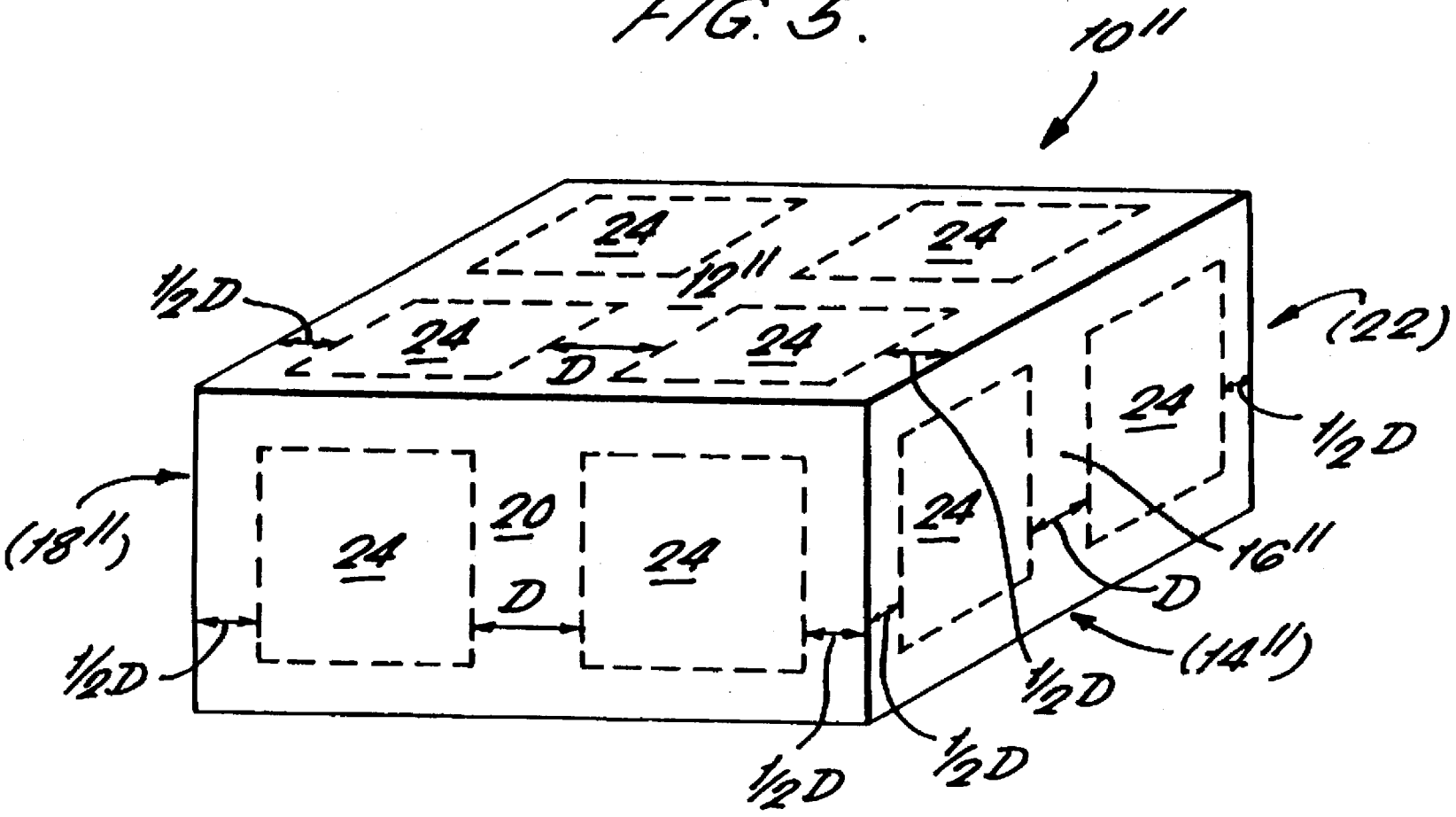
FIG. 5 is a schematic perspective view of a building block in accordance with a third embodiment of the first aspect of the present invention.

It will be apparent to those skilled in the art that whilst the blocks have been described as being provided with a specific number of interlocking formations on each of their opposing surfaces, these numbers are given by way of example only and are not intended to limit the number of formations that may be provided on such blocks. For this reason two further blocks which are provided on their opposing surfaces with a different number of interlocking formations are shown in FIGS. 4 and 5. By providing blocks having a different number of interlocking formations and which as a result are of different external dimensions, it is possible to achieve a construction having dimensions that are an integral multiple of the shortest dimension of the shortest block. This in turn eliminates the wastage inherant in the cutting of building blocks and allows the use of standard size fitments such as door or window frames.

It will also be apparent to those skilled in the art that whilst the formations provided on one of the surfaces of each pair of opposing surfaces have been described as being spaced apart to the same extent of those provided on the corresponding surface of the other two pairs of opposing surfaces, this need not necessarily be the case. By spacing the formations apart in this way however two such building blocks may be arranged in interlocking engagement in an increased number of orientations.

Likewise, whilst the formations have been described as being symetric about a rotation of 90° it will be apparent to those skilled in the art that this also need not necessarily be the case although two such blocks may be arranged in interlocking engagement in yet a further increased number of orientations.

Assuming that it is desired for each of the formations to be symetric about a rotation of 90° it will be apparent to those skilled in the art that the formations may comprise an arrangement other than that described above without departing from the scope of the present invention. For example, the formations need not necessarily comprise a square matrix of projecting and recessed elements. Instead the elements could be disposed in the form of one or more concentric circles. Likewise the elements themselves need not necessarily be in the form of a square based pyramid but rather could comprise either projecting or recessed hemispheres.

Figure 6:
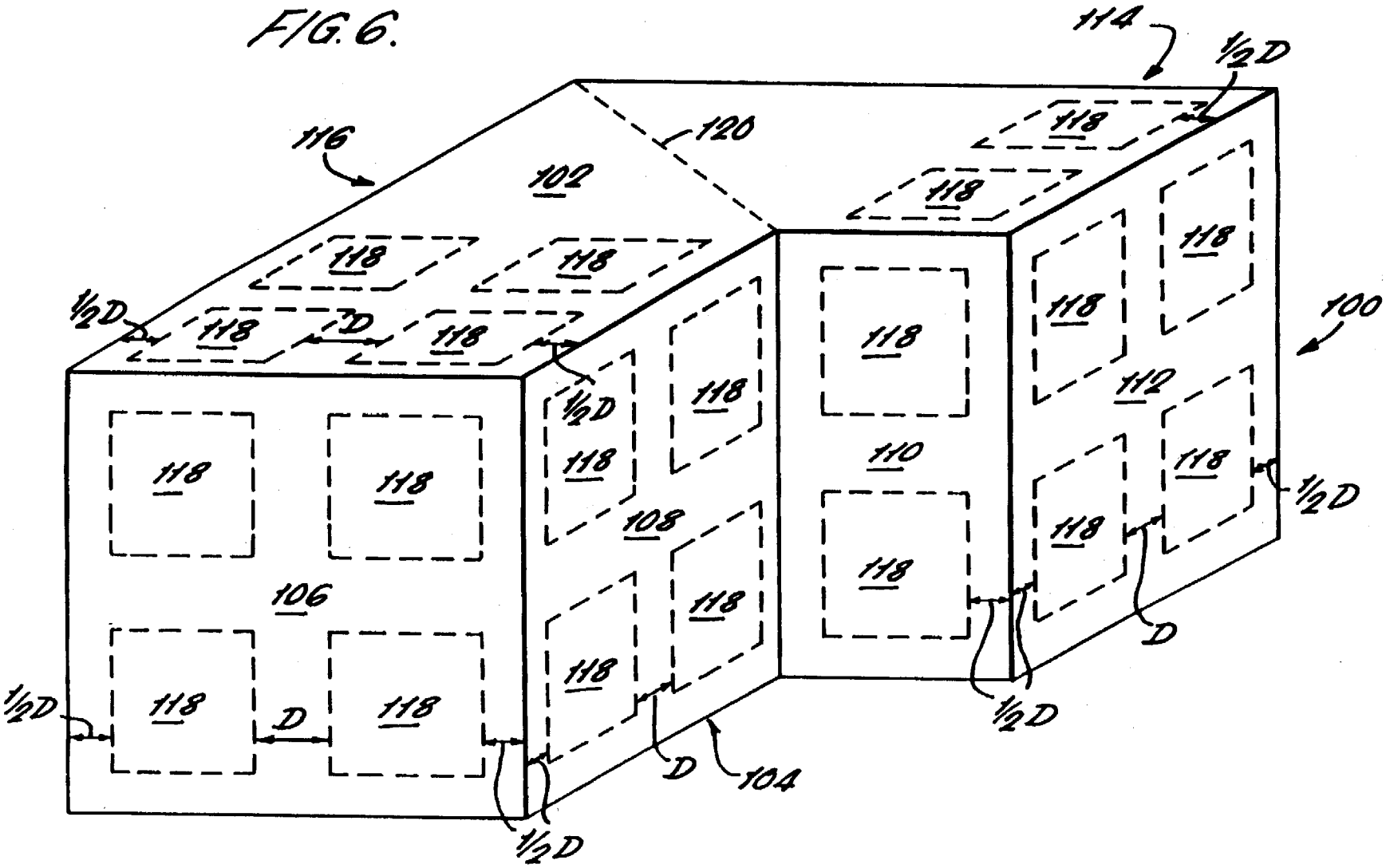
FIG. 6 is a schematic perspective view of a corner block in accordance with the second aspect of the present invention.

In FIG. 6 there is shown a corner block 100 capable of being arranged in interlocking engagement with one or more building blocks 10 of the type previously described in order, for example, to turn the corner of a wall. As can be seen, the corner block 100 comprises opposed upper and lower, generally L-shaped surfaces 102 and 104 having interjoining side surfaces 106–116. All eight of the surfaces 102–116, are provided with one or more identical formations 118 which are disposed, in the case of side surfaces 108 and 116, toward the side surface 106 and, in the case of side surfaces 110 and 114, are disposed toward the side surface 112. In the case of the upper and lower surfaces 102 and 104 the formations 118 are again disposed toward the side surfaces 106 and 112 and remote from an imaginary line 120 joining the intersection of side surfaces 108 and 100 with that of side surfaces 114 and 116. As with the building blocks 10 of the type previously described, each of the formations 118 are spaced a distance D from the nearest neighbouring formations and a distance ½D from the edges of the surface concerned.

Figure 7:
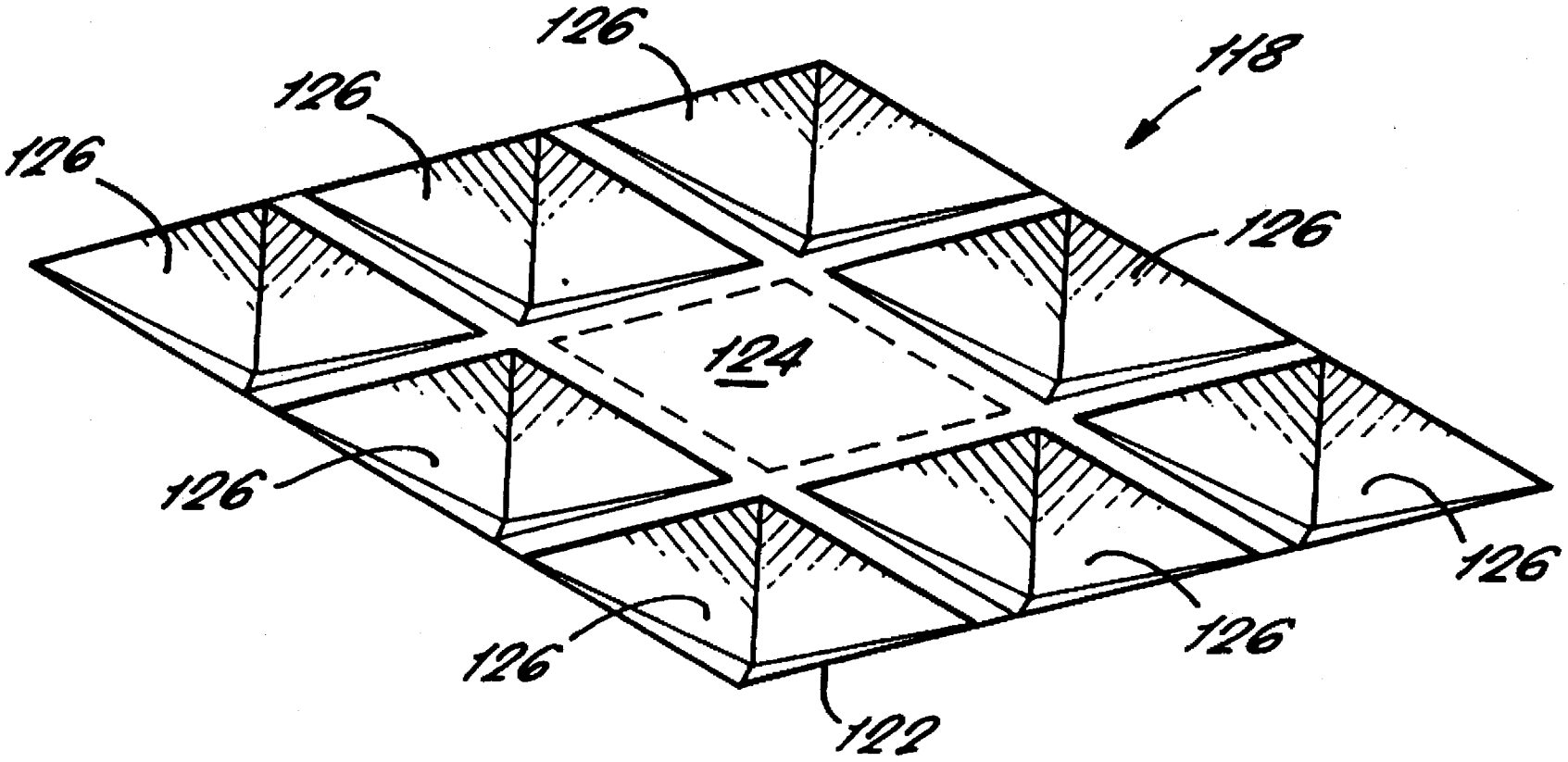
FIG. 7 is a perspective view of a third type of formation provided on the corner block of FIG. 6.

One of the formations 118 is shown in more detail in FIG. 7 to comprise a three-by-three matrix of elements arranged in the form of square 122 in which the central element 124 is substantially co-planar with the relevant surface of the corner block 100. In contrast with the formations 24 and 26 previously described all eight of the remaining elements comprise recesses 126 in the shape of square based pyramids.

In use, in order to arrange the corner block 100 in interlocking engagement with one of the building blocks 10 previously described, all that is required is to place any one of the surfaces 12–22 of the building block 10 in abutting relationship with any one of the surfaces 102–116 of the corner block 100. In this way one or more of either the first or second type of formations 24 or 26 are brought into engagement with a corresponding number of the third type of formations 118 with the result that the projections 56 or 64 of the first or second type of formations 24 or 26 are received within the recesses 126 of the third type of formations 118.

Since both the first and the second type of formations 24 and 26 may engage with the third type of formations 118, the corner block 100 is neither right-handed nor left-handed and may be arranged in interlocking engagement with one or more of the building blocks 10 of the type previously described in any desired orientation.

It will be apparent to those skilled in the art that whilst the side surfaces 108 and 110 have been shown as subtending an included angle of 90°, as have side surfaces 116 and 114, this need not necessarily be the case. Indeed the corner block 100 may be so designed as to have an included angle of any desired value. Thus, for example, corner blocks may be provided in which the side surfaces 108 and 110 subtend any one of a range of angles at 15° intervals from 90° to 165°. In each case it is anticipated that the angle subtended by the side surfaces 108 and 110 would be equal to that subtended by the side surfaces 114 and 116 although this need not necessarily be the case.

It will also be apparent to those skilled in the art that whilst the corner block 100 has been shown in FIG. 6 as being provided with a specific number of formations on each of its surfaces, these numbers are only shown by way of example and are not intended to limit the number of formations that may be provided on such a corner block.

It will also be apparent to those skilled in the art that whilst the formations 118 provided on any one of the surfaces of the corner block 100 have been described as being spaced apart to the same extent as those provided on the other surfaces, this again need not necessarily be the case. By spacing the formations 118 apart in this way however, the corner block 100 may be arranged in interlocking engagement with one or more of the building blocks 10 previously described in an increased number of orientations.

Likewise, whilst the formations 118 have been described as being symmetric about a rotation of 90°, it will be apparent to those skilled in the art that this also need not necessarily be the case although such a corner block 100 may be arranged in interlocking engagement with one or more of the building blocks 10 previously described in yet a further increased number of orientations.

Assuming that it is desired for the formations 118 to be symmetric about a rotation of 90°, it will be apparent to those skilled in the art that the formations 118 may comprise an arrangement other than that described without departing from the scope of the present invention. For example, the formations 118 may take the form of one or other of the first or second type of formations 24 or 26. Whilst in some arrangements this would still enable the corner block 100 to be arranged in interlocking engagement with one or more of the building blocks 10 previously described, it would also provide the corner block 100 with a sense of either left or right-handedness and so reduce the number of possible orientations in which the corner block 100 and the said one or more of the building blocks 10 may be arranged.

One advantage of building blocks and corner blocks that interlock is that they may be used to build a construction having a greater integrity. As a result, less mortar need be used between blocks of this type in order to achieve a construction that has the same integrity as one built of conventional house bricks. Indeed in the case of the blocks described the use of mortar to cement the blocks together may be dispensed with in certain applications to be replaced by the use of a sealant possibly having a natural or synthetic rubber base. This would provide further advantages in that, unlike mortar, there would be no requirement to mix the sealant prior to its application, the application of the sealant to the blocks would be less demanding to the unskilled handy man, and the resulting construction would be airtight since, again unlike mortar, the sealant would have the property of preventing the ingress of air and damp. This last advantage is of particular benefit to the construction of cavity walls as there would no longer be a requirement to fill the cavity with an additional insulating medium to counter the effects of the air and damp that pass through the mortar of conventional constructions.

The building blocks and corner blocks described may be made of high pressure molded cement in order to achieve the required definition. Alternatively, where the blocks are to find use in the construction of items such as greenhouses or storage sheds, they may be of molded plastics material. In another embodiment the blocks may be of recycled glass.

Irrespective of the material from which they are formed, the building blocks and corner blocks may be hollow and contain either an insulating material or a vacuum.

The building blocks and corner blocks may also contain one or more reinforcing rods to provide the blocks with sufficient strength to find use as lintels or supports. Blocks of the type described and equiped with reinforcing rods may also be used in high security constructions such as bank vaults, prisons or military establishments.

It will be apparent to those skilled in the art that whilst blocks of the type described may be arranged in mutual interlocking engagement, that engagement is such as to allow some slight movement and as a result the blocks are particularly suitable for use in areas prone to earthquakes or earth tremors.

I claim:

1. A building block for the construction industry comprising a rectangular parallelepiped having three pairs of opposing surfaces, each of a pair of opposing surfaces being provided with at least one of a respective one of a pair of interlocking formations such that the formations on any given surface are identical, each of said pair of interlocking formations being symmetrical about a rotation of 90°, whereby two such building blocks may be arranged with one of a pair of opposing surfaces of a first of the blocks in interlocking engagement with one of any of the three pairs of opposing surfaces of the other of the blocks.

2. A building block in accordance with claim 1, wherein the formations provided on one of the surfaces of each pair of opposing surfaces are spaced apart to a same extent as those provided on a corresponding surface of the other two pairs of opposing surfaces.

3. A building block in accordance with claim 1, wherein each of a formations comprises a square matrix of projecting and recessed elements.

4. A building block in accordance with claim 3, wherein the projecting and recessed elements are each in the form of a square based pyramid.

5. A building block in accordance with claim 1, wherein the rectangular parallelepiped is hollow.

6. A building block in accordance with claim 5, wherein the block has a cavity which contains a heat insulating material.

7. A building block in accordance with claim 5, wherein the block has a cavity which is evacuated.

8. A building block in accordance with claim 1 and containing one or ore reinforcing elements.

9. A corner block for use with a building block in accordance with claim 1, the corner block subtending an included angle and being provided with one or more formations on each of its surfaces whereby the corner block may be arranged with one of its surfaces in interlocking engagement with one of at least one of each pair of opposing surfaces of said building block.

10. A corner block in accordance with claim 9, wherein each of the formations provided on the surfaces thereof comprise a square matrix of at least one element selected form a group consisting of projecting and recessed elements.

11. A corner block in accordance with claim 10, wherein the projecting and recessed elements are each in a form of a square based pyramid.

12. A corner block in accordance with claim 9, wherein each of the formations provided on the surfaces thereof are such as to allow the corner block to be arranged with one of its surfaces in interlocking engagement with one of any of the three pairs of opposing surfaces of said building block.

13. A corner block in accordance with claim 12, wherein each of the formations provided on the surfaces thereof are identical.

14. A corner block in accordance with claim 12, wherein each of the formations provided on the surfaces of the corner block comprise a square matrix of solely recessed elements.

15. A corner block in accordance with claim 14, wherein the recessed elements are each in the form of a square based pyramid.

16. A corner block in accordance with claim 9, wherein the included angle is an integer multiple of 15° within the range from 90° to a 165°.

17. A corner block in accordance with claim 9, wherein the corner block is hollow.

18. A corner block in accordance with claim 17, wherein the corner block contains a heat insulating material.

19. A corner block in accordance with claim 17, wherein the corner block is evacuated.

20. A corner block in accordance with claim 9, wherein the corner block contains one or more reinforcing elements.

21. A construction comprising a first building block and selectively at least one of a second identical building block and a corner block, said first building block being in a form of a rectangular parallelepiped having three pairs of opposing surfaces, each surface of a pair of opposing surfaces being provided with at least one interlocking formation of a pair of complementary interlocking formations such that when more than one interlocking formation is provided on a respective surfaces, the interlocking formations on any given surface are identical, each of said pair of interlocking formations being symmetrical about a rotation of 90°, and the corner block subtending an included angle and being provided with at least one interlocking formation on each of its surfaces, the blocks being arranged with one of a pair of opposing surfaces of said first building lock in interlocking engagement selectively with one surface of any of the three pairs of opposing surfaces of said second building block when said second building block is selected, and with one of the surfaces of said corner block when said corner block is selected.

22. A construction in accordance with claim 21, wherein the blocks are cemented together by means of an airtight sealant.

* * * * *

UNITED STATES PATENT AND TRADEMARK OFFICE

CERTIFICATE OF CORRECTION

PATENT NO. : 5,666,777

DATED : September 16, 1997

INVENTOR(S) : Murphy

It is certified that error appears in the above-identified patent and that said Letters Patent is hereby corrected as shown below:

On the title page:

Section [56] REFERENCES CITED

Under U.S. PATENT DOCUMENTS

Insert --3,229,439 1/1966 G.F. Strobel 52/591--

Under FOREIGN PATENT DOCUMENTS

Insert --2 111 907 7.12.72 Germany--

Column 7, line 50, delete "ore" and insert --more--.

Column 8, line 4, delete "form" and insert --from--.

Column 8, line 47, delete "lock" and insert --block--.

Signed and Sealed this

Seventh Day of April, 1998

Bruce Lehman

*Attest:*

BRUCE LEHMAN

*Attesting Officer*

*Commissioner of Patents and Trademarks*